US007213410B2

(12) United States Patent
Lipp et al.

(10) Patent No.: US 7,213,410 B2
(45) Date of Patent: May 8, 2007

(54) REFRIGERATOR

(75) Inventors: Walter Lipp, Haunsheim (DE); Michael Neumann, Ulm (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 337 days.

(21) Appl. No.: 10/873,399

(22) Filed: Jun. 21, 2004

(65) Prior Publication Data

US 2005/0005630 A1 Jan. 13, 2005

Related U.S. Application Data

(63) Continuation of application No. PCT/EP02/14078, filed on Dec. 11, 2002.

(30) Foreign Application Priority Data

Dec. 21, 2001 (DE) ..... 101 63 187

(51) Int. Cl.
*F25D 11/02* (2006.01)

(52) U.S. Cl. ..... 62/441

(58) Field of Classification Search ..... 62/440, 62/441, 443, 444, 446, 519, 520, 521, 522, 62/524

See application file for complete search history.

(56) References Cited

U.S. PATENT DOCUMENTS

| | | | | |
|---|---|---|---|---|
| 2,497,734 A | | 2/1950 | Kuklich | |
| 2,717,189 A | | 9/1955 | Teague et al. | |
| 3,851,765 A | | 12/1974 | Cox | |
| 4,353,223 A | * | 10/1982 | Dienemann | 62/442 |
| 4,690,468 A | * | 9/1987 | Lau | 312/291 |
| 5,004,302 A | * | 4/1991 | Stocking et al. | 312/408 |
| 5,485,732 A | * | 1/1996 | Locatelli | 62/520 |
| 5,875,642 A | * | 3/1999 | Lee et al. | 62/256 |
| 6,314,746 B2 | * | 11/2001 | Ohya et al. | 62/187 |
| 6,547,349 B2 | * | 4/2003 | Sessa et al. | 312/352 |
| 6,565,170 B2 | * | 5/2003 | Banicevic et al. | 312/404 |
| 6,601,394 B2 | * | 8/2003 | Tatter | 62/127 |

FOREIGN PATENT DOCUMENTS

| | | | |
|---|---|---|---|
| CH | 232732 | | 9/1944 |
| DE | 2133519 A | * | 7/1984 |
| DE | 3305764 A | * | 8/1984 |
| FR | 2 631 688 A3 | | 11/1989 |
| JP | 03158683 A | | 7/1991 |

* cited by examiner

*Primary Examiner*—Mohammad M. Ali
(74) *Attorney, Agent, or Firm*—Russell W. Warnock; Craig J. Loest

(57) ABSTRACT

A refrigerating appliance contains an inner chamber that is surrounded by a heat-insulating housing and a door, and can be divided into an upper region and a lower region by a partition wall. The refrigerating appliance also contains a plate-type evaporator that is supported on a wall of the inner chamber. The evaporator extends over at least part of the wall pertaining to the lower region, and the cooling performance of the evaporator, in its part pertaining to the upper or lower region, is such that the temperature reached in the upper region of the inner chamber is lower than that reached in the lower region.

20 Claims, 5 Drawing Sheets

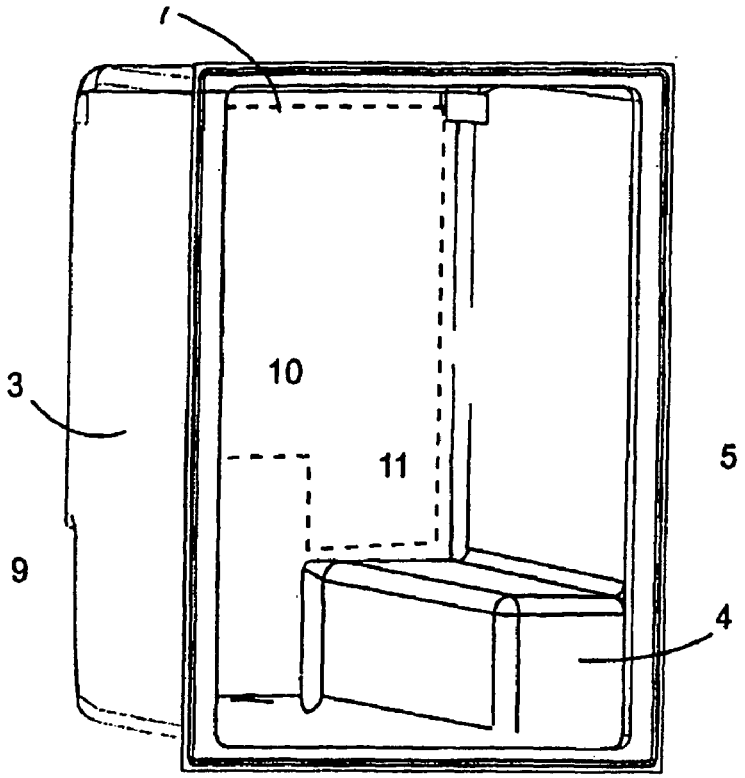
FIG. 8
FIG. 9
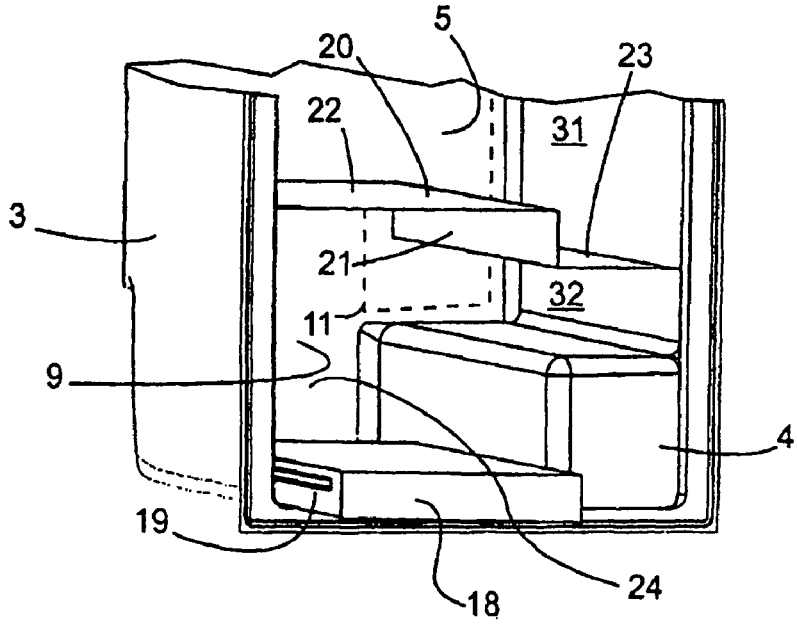

REFRIGERATOR

CROSS-REFERENCE TO RELATED APPLICATION

This application is a continuation, under 35 U.S.C. § 120, of copending international application No. PCT/EP02/14078, filed Dec. 11, 2002, which designated the United States; this application also claims the priority, under 35 U.S.C. § 119, of German patent application No. 101 63 187.1, filed Dec. 21, 2001; the prior applications are herewith incorporated by reference in their entirety.

BACKGROUND OF THE INVENTION

Field of the Invention

The invention relates to a refrigerator having an interior which is enclosed by a heat-insulating housing and a door. The refrigerator has a panel-shaped evaporator which is disposed on a wall of the interior which is located opposite the door.

In refrigerators which are commonly available at present, for example table refrigerators or built-in refrigerators, combined appliances, etc., a shelf for drink containers is generally provided on an inner side of the door. A reason for drink containers preferably being disposed in the region of the door is that, on account of a relatively high incidence of heat in this region, a relatively high temperature prevails here in comparison with the rest of the interior. The relatively high temperature making it possible for drinks to be kept at a pleasant drinking temperature and for other items accommodated in the rest of the interior of the refrigerator to be kept at a lower temperature.

In order to reduce the energy consumption of the refrigerators, it is desirable for these also to be provided with highly effective insulation in the door region. A consequence of such improved insulation is the reduction in the above-mentioned difference in temperature, with the result that, in order for drinks to be kept at a pleasant temperature, it is necessary to set a temperature in the interior which is not optimum for the storage of other items, or that, if the storage temperature for these other items is selected to be optimum, there is a risk of the drinks stored in the door region being excessively cooled.

SUMMARY OF THE INVENTION

It is accordingly an object of the invention to provide a refrigerator which overcomes the above-mentioned disadvantages of the prior art devices of this general type, which, even with the presence of heat insulation which is highly effective all the way round, allows the formation of a zone, within the interior, which is suitable for accommodating drink containers.

With the foregoing and other objects in view there is provided, in accordance with the invention, a refrigerator. The refrigerator contains a heat-insulating housing enclosing an interior and having a wall, the interior defining a top zone and a bottom zone. A door is connected to the housing. A panel-shaped evaporator is supported by the wall of the housing. The evaporator is provided for cooling the interior and extends over at least part of the wall that belongs to the bottom zone of the interior when the refrigerator is in an operating position. A cooling capacity of the evaporator of the top zone and of the bottom zone is such that a lower temperature is reached in the top zone of the interior than in the bottom zone. The evaporator has a rectangle form with a section having been cut away at one of its corners in that part of the evaporator that extends over the bottom zone. A drawer is disposed in the interior in front of the section.

A straightforward possibility of achieving the temperature distribution is to fit the evaporator such that the region of the wall that belongs to the bottom zone is covered by the evaporator to a lesser extent than the part that belongs to the top zone. The top zone is usually completely filled by the evaporator.

The evaporator is usually defined as a rectangular panel. According to the invention, in order to reduce the cooling capacity of the evaporator in the bottom zone, a section has been cut away from a bottom corner of the panel. In this way a region of reduced cooling capacity is easily provided.

It is also conceivable, however, instead of doing away altogether with the evaporator panel in this section, merely for the density of the refrigerant lines in this section to be selected to be lower than over the rest of the surface area of the evaporator, or, in the extreme case, for the refrigerant lines to be done away with altogether.

A drawer is preferably disposed in the interior of the refrigerator, in front of the cut-away section or the section of reduced cooling capacity. The drawer makes it possible for a plurality of packs to be positioned one behind the other in the depth wise direction of the interior and for easy access to be gained to each of the packs by virtue of the drawer being pulled out.

The height of the cut-away or reduced-cooling-capacity section is expediently selected such that the drawer, e.g. in the form of a pull-out compartment, is capable of accommodating a drink pack in an upright position. It is possible to use here, as a measure of the height, a common type of pack, for example a Tetrapack, a standard 0.7 liter mineral-water bottle or a 1.5 liter or 2 liter PET bottle.

Refrigerators usually have a recessed portion in the bottom region of their interior, the refrigerating machine being accommodated on the outside of this recessed portion. In the case of the refrigerator according to the invention, the recessed portion is preferably offset laterally in relation to the cut-away or reduced-cooling-capacity section of the evaporator, with the result that, in order to store the drink packs, it is possible to utilize that region on the base of the interior that is located alongside the recessed portion.

In order to regulate the extent of cooling of the drink-storage zone in a suitable manner, it is possible to dispose in the interior a partition wall which is aligned with at least part of the periphery of the region of reduced cooling capacity and, although not necessarily preventing an exchange of heat between the drink-storage zone and the rest of the interior by way of convection, at least limits the exchange of heat. The partition wall may be formed, for example, by a shelf with two shelf sections that extend on different horizontal levels and are connected by a vertical wall. It is also conceivable to have a partition wall that contains a vertical intermediate wall and a shelf which extends from the intermediate wall to a side wall of the interior.

The evaporator of the refrigerator is preferably a coldwall evaporator.

Other features which are considered as characteristic for the invention are set forth in the appended claims.

Although the invention is illustrated and described herein as embodied in a refrigerator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 8 is a perspective view of an inner wall of the refrigerator according to a modification of the refrigerator shown in FIG. 1;

FIG. 9 is a perspective view of a bottom region of the inner wall from FIG. 7 with a drawer and a partition wall according to a first configuration.

DESCRIPTION OF THE PREFERRED EMBODIMENTS

Figure 1:
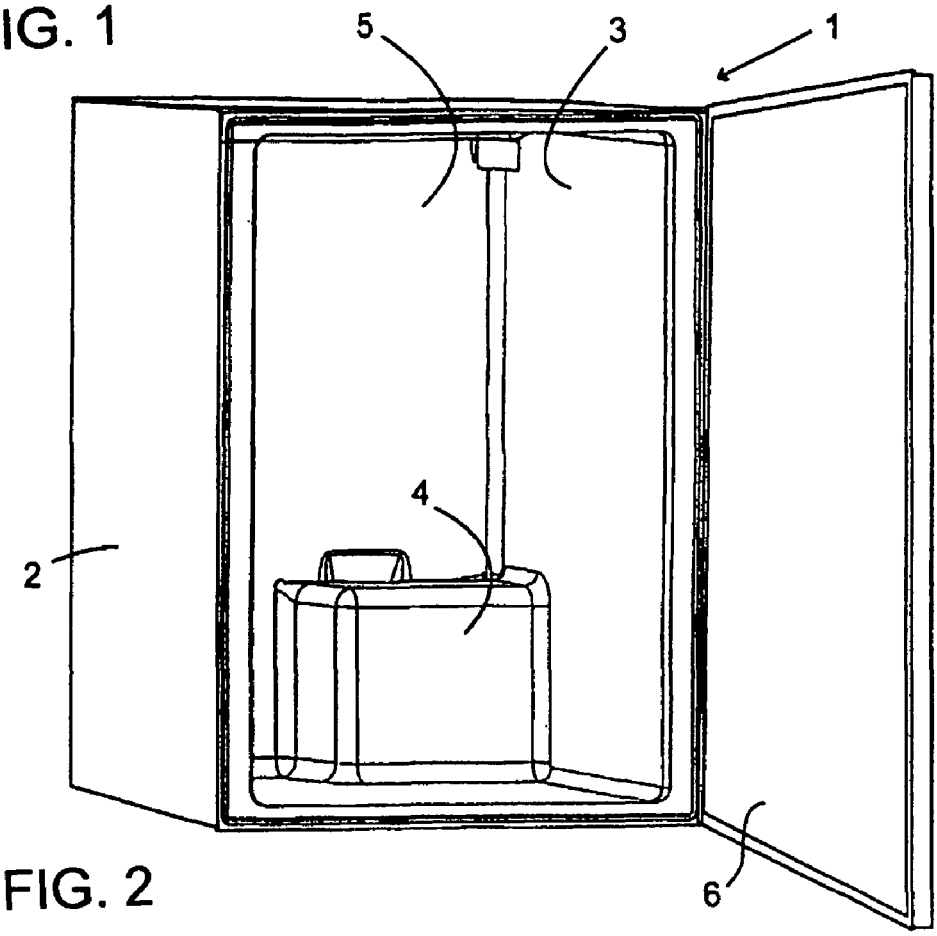
FIG. 1 is a diagrammatic, perspective view of a refrigerator with an open door according to the invention.

Referring now to the figures of the drawing in detail and first, particularly, to FIG. 1 thereof, there is shown a perspective view of a refrigerator 1 with an open door 6. A heat-insulating housing 2 of the refrigerator 1 is constructed from a solid outer wall e.g. made of sheet metal, an inner wall 3, that is thermoformed in one piece from plastic, and a foam layer which fills an interspace between the inner wall 3 and the outer wall. In the region of its bottom right-hand corner, the inner wall 3 has an approximately cuboidal recessed portion 4, behind which a refrigerating machine is accommodated. A coldwall evaporator, which is connected to the refrigerating machine, is disposed on a rear wall 5 of the housing, between the inner wall 3 and the foam layer, and cannot be seen in the FIG. 1. A partition wall for dividing up the interior into a top zone and bottom zone has been left out of FIG. 1.

Figure 2:
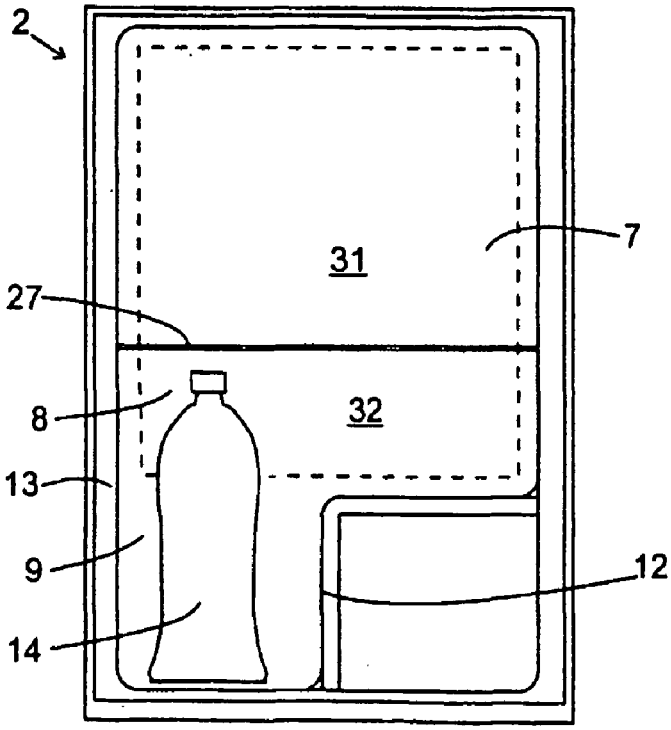
FIGS. 2 and 3 are front views of the refrigerator from FIG. 1 without the door.

The configuration of the coldwall evaporator is indicated as a dashed outline in FIG. 2, which illustrates a front view of the refrigerator 1 without the door 6. The evaporator 7 is in the form of a rectangle that extends from the top periphery of the rear wall 5 to the topside of the recessed portion 4 and over the entire width of the rear wall 5.

A horizontal shelf 27 subdivides the interior of the refrigerator 1 into a top zone 31, the rear wall 5 here being virtually completely filled by the panel of the evaporator 7, and a bottom zone 32, in which the rear wall 5 is only partly filled by the evaporator 7. The height of the shelf 27 is selected such that a drink bottle 14 can be placed in an upright position in the bottom zone 32.

Figure 3:
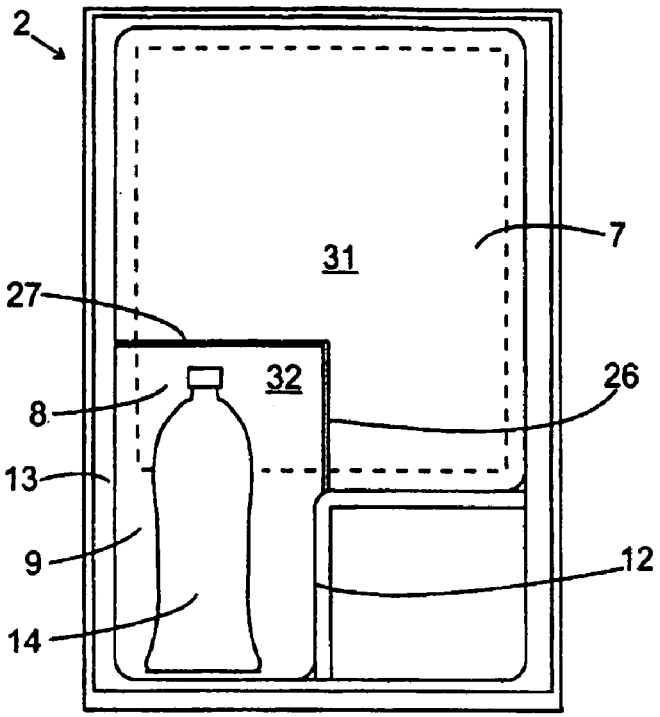

As FIG. 3 shows, the partition wall 27 need not extend over the entire width of the interior; it may also be formed, as is the case here, from a vertical intermediate wall 26 and a shelf which extends from one side wall to just as far as the intermediate wall 26.

Figure 4:
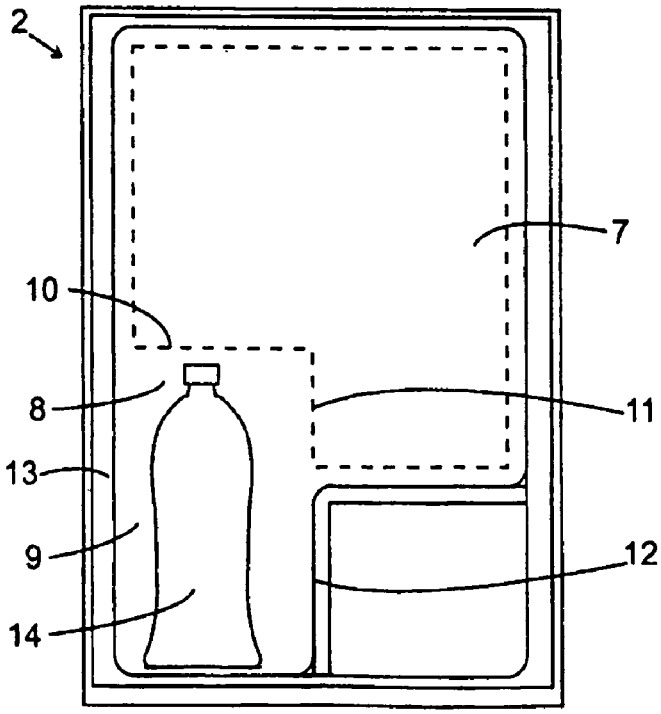
FIG. 4 is a front view, analogous to FIG. 2, of a preferred configuration of the refrigerator.

FIG. 4 shows, in a manner similar to FIGS. 2 and 3, a front view of the refrigerator 1 in accordance with a preferred configuration. The partition wall between the top and bottom zones has been left out here in order for it to be possible for the configuration of the evaporator 7 to be illustrated more clearly. The evaporator 7 is essentially in the form of a rectangle that, in the top zone 31 of the refrigerator 1, fills the rear wall 5 over its entire width, and, in the region of its bottom left-hand corner, has a rectangular cut-away section or cutout 8. A rectangular section 9 of the rear wall 5 that does not have the evaporator 7 as a backing is bounded by the edges 10, 11 of the cutout 8 by a sidewall 12 of the recessed portion 4 and by a base and by a sidewall 13 of the housing 2. The height of the section 9 corresponds approximately to that of the drink bottle 14, as illustrated in outline.

Figure 5:
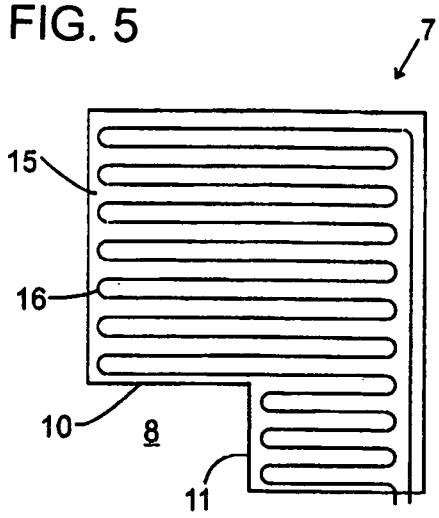
FIGS. 5 to 7 are illustrations showing different exemplary embodiments of an evaporator for the refrigerator shown in FIGS. 1 and 3.

FIG. 5 shows a front view of the evaporator 7 from FIG. 4; it is constructed from a metal panel 15, which is provided for its adhesive bonding to the inner wall 3, and from a refrigerant line 16, which runs in a serpentine fashion over the rear side of the metal panel 15, the rear side being directed toward the foam layer.

Figure 6:
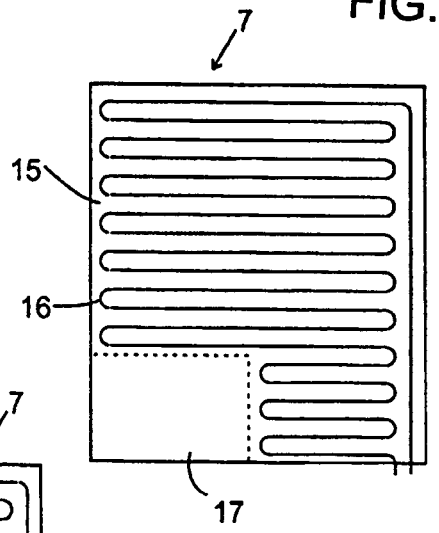

FIG. 6 shows a modification of the evaporator 7, in which the metal panel 15 is precisely rectangular and does not have a cut-away section. However, the refrigerant line 16 does not extend into a section 17 in the region of the bottom left-hand corner, the section 17 being delimited by a dashed line. The section 17 is thus cooled, if need be, by thermal conduction via the metal panel 15 from the periphery and only has a low cooling capacity in comparison with the rest of the surface area of the evaporator 7.

Figure 7:
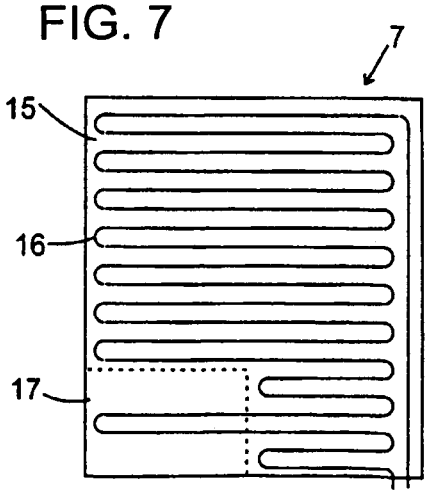

In the case of the modification of the evaporator 7 which is shown in FIG. 7, the refrigerant line 16 does indeed extend into the section 17, but the density of the refrigerant line 16 in section 17, it being possible to define this density as length of line per unit surface area, is lower in section 17 than over the rest of the surface area of the metal panel 15, with the result that it is also the case with this configuration of the evaporator that the section 17 has a relatively low cooling capacity in comparison with the rest of the surface area of the evaporator.

FIG. 8 shows a perspective view of the inner wall 3 of the refrigerator 1 according to the invention in a modification of FIG. 1. In the case of this modification, the recessed portion 4 is extended over essentially the entire depth of the interior, as a result of which the height of the recessed portion 4 that is necessary for accommodating the refrigerating machine is reduced. The outline of the evaporator 7 on the rear wall 5 is, once again, indicated as a dashed line.

FIG. 9 shows the bottom region of the inner wall 3 from FIG. 8, a drawer 18 which can be pulled out on telescopic rails 19 being fitted on the base of the interior, in front of the evaporator-free section 9 of the rear wall 5. By virtue of the drawer 18 being pulled out, it is easily possible to gain access to a drink container that is located in the drawer 18 directly adjacent to the rear wall 5, without other containers having to be first removed.

A shelf 20 with two shelf sections 22, 23 which are connected by a vertical wall 21 delimits the drink-storage zone 24, which together with a volume located between the topside of the recessed portion 4 and the shelf section 23 forms the bottom zone 32 of the interior, from the top zone 31 of the interior located above. The top shelf section 22 extends approximately level with the horizontal edge 10 (which is concealed in FIG. 9) of the cutout 8; the vertical wall 21 is aligned with the sidewall 12 of the recessed portion 4 and with the vertical edge 11 of the cutout 8.

The shelf 20 does not extend right up to the rear wall 5, with the result that the otherwise continuous panels which the shelf sections 22, 23 and the wall 21 contain do indeed limit, but do not fully preclude, an exchange of heat by airflow between the drink-storage zone 24 or the bottom zone 32 and the top zone 31 of the interior. The size of the necessary through-passage cross sections between the drink-storage zone 24 and the top zone 31 depends, from case to case, on the desired temperature conditions and on the insulation and on whether the evaporator is an evaporator according to FIG. 5, which does not have any cooling capacity in the region of the drink-storage zone 24, or whether use is made of an evaporator according to FIG. 6 or 7, the cooling capacity of which is merely reduced in the region of the drinks-storage zone 24.

Figure 10:
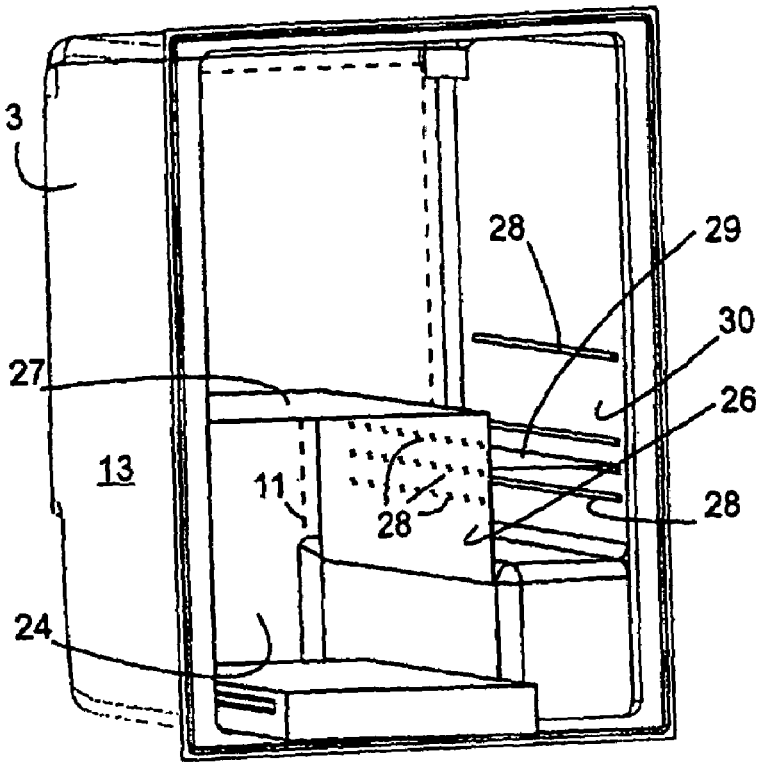
FIG. 10 is a perspective view of the inner wall from FIG. 8 with a drawer and a second configuration of a partition wall.

In the case of the modification of FIG. 10, the partition wall between the drink-storage zone 24 and the rest of the interior of the refrigerator 1 is formed by a vertical intermediate wall 26, which is aligned with the side wall 12 of the recessed portion 4 and the vertical edge 11 of the cutout 8, and by a shelf 27, which extends from the top end of the intermediate wall 26, approximately level with the horizontal edge 10 of the cutout 8, to the right-hand side wall 13 of the housing 2. Here too, for the above-mentioned reasons, the partition wall does not extend right up to the rear wall 5. On its side that is directed away from the drink-storage zone 24, the intermediate wall 26 bears a plurality of rails 28 which, together with complementary rails 28, on the sidewall 30 of the housing 2, may serve as a rest for a reduced-width shelf 29.

Further non-illustrated shelves that extend over the entire width of the interior may, of course, be provided above the drink-storage zone 24.

We claim:

1. A refrigerator, comprising:

a heat-insulating housing enclosing an interior and having a wall, said interior defining a top zone and a bottom zone;

a door connected to said housing;

a panel-shaped evaporator supported by said wall of said housing, said evaporator provided for cooling said interior and extends over at least part of said wall which belongs to said bottom zone of said interior when the refrigerator is in an operating position, a cooling capacity of said evaporator of said top zone and of said bottom zone is such that a lower temperature is reached in said top zone of said interior than in said bottom zone, the temperature of both the top and bottom zones being above freezing, said evaporator having a rectangle form with a section having been cut away at one of its corners in that part of said evaporator which extends over said bottom zone; and a drawer disposed in said interior in front of said section.

2. The refrigerator according to claim 1, further comprising a partition wall disposed in said interior, said partition wall subdividing said interior into said top zone and said bottom zone.

3. The refrigerator according to claim 1, wherein that part of said wall which belongs to said bottom zone is covered by said evaporator to a lesser extent than a further part of said wall which belongs to said top zone.

4. The refrigerator according to claim 1, wherein said section has a rectangular shape.

5. The refrigerator according to claim 1, wherein a height of said section is selected such that said drawer is capable of accommodating a drink pack in an upright position.

6. The refrigerator according to claim 1, wherein said interior has a recessed portion provided for accommodating a refrigerating machine.

7. The refrigerator according to claim 6, wherein said section of said evaporator is offset laterally in relation to said recessed portion.

8. The refrigerator according to claim 2, wherein said partition wall is a shelf with two shelf sections which extend on different horizontal levels and are connected by a vertical wall.

9. A refrigerator, comprising:

a heat-insulating housing enclosing an interior and having a wall, said interior defining a top zone and a bottom zone;

a door connected to said housing;

a panel-shaped evaporator supported by said wall of said housing, said evaporator provided for cooling said interior and extends over at least part of said wall which belongs to said bottom zone of said interior when the refrigerator is in an operating position, a cooling capacity of said evaporator of said top zone and of said bottom zone is such that a lower temperature is reached in said top zone of said interior than in said bottom zone, said evaporator, in an area of said wall belonging to said bottom zone, having a section with a reduced cooling capacity in comparison with a rest of a surface area of said evaporator; and a drawer disposed in said interior in front of said section.

10. The refrigerator according to claim 9, further comprising a partition wall disposed in said interior, said partition wall subdividing said interior into said top zone and said bottom zone.

11. The refrigerator according to claim 9, wherein that part of said wall which belongs to said bottom zone is covered by said evaporator to a lesser extent than a further part of said wall which belongs to said top zone.

12. The refrigerator according to claim 9, wherein in said section of reduced cooling capacity, a density of refrigerant lines is lower than over a rest of said surface area of said evaporator.

13. The refrigerator according to claim 9, wherein said section of reduced cooling capacity has a rectangle shape.

14. The refrigerator according to claim 9, wherein a height of said section is selected such that said drawer is capable of accommodating a drink pack in an upright position.

15. The refrigerator according to claim 9, wherein said interior has a recessed portion provided for accommodating a refrigerating machine.

16. The refrigerator according to claim 15, wherein said section of reduced cooling capacity of said evaporator is offset laterally in relation to said recessed portion.

17. The refrigerator according to claim 10, wherein said partition wall is aligned with at least part of a periphery of said section of reduced cooling capacity.

18. The refrigerator according to claim 17, wherein said partition wall is a shelf with two shelf sections which extend on different horizontal levels and are connected by a vertical wall.

19. A refrigerator, comprising:

a heat-insulating housing enclosing an interior and having a wall, said interior defining a top zone and a bottom zone; and a panel-shaped evaporator supported by said wall of said housing, said evaporator provided for cooling said interior and extends over at least part of said wall which belongs to said bottom zone of said interior when the refrigerator is in an operating position, a cooling capacity of said evaporator of said top zone and of said bottom zone is such that a lower temperature is reached in said top zone of said interior than in said bottom zone, said evaporator, in an area of said wall belonging to said bottom zone, having a section with a reduced cooling capacity in comparison with a rest of a surface area of said evaporator.

20. The refrigerator according to claim 19, wherein in said section of reduced cooling capacity, a density of refrigerant lines is lower than over a rest of said surface area of said evaporator.

* * * * *